United States Patent [19]

Lewis

[11] Patent Number: 4,465,585

[45] Date of Patent: Aug. 14, 1984

[54] CHOLESTERIC MESOPHASE PITCH

[75] Inventor: Irwin C. Lewis, Strongville, Ohio

[73] Assignee: Union Carbide Corporation, Danbury, Conn.

[21] Appl. No.: 363,559

[22] Filed: Mar. 30, 1982

[51] Int. Cl.[3] ..... C10C 3/02; C09K 3/34; C07C 2/02

[52] U.S. Cl. ..... 208/22; 585/422; 585/425; 528/396; 208/44

[58] Field of Search ..... 208/22, 44; 528/396; 423/447.2, 447.4, 447.6, 449; 585/422, 425

[56] References Cited

U.S. PATENT DOCUMENTS

| | | | |
|---|---|---|---|
| 3,529,934 | 9/1970 | Shindo | 423/447.6 |
| 3,966,887 | 6/1976 | Chiche | 423/447.6 |
| 4,303,631 | 12/1981 | Lewis et al. | 264/29.2 |
| 4,412,059 | 10/1983 | Krigbaum et al. | 528/192 |

OTHER PUBLICATIONS

*Liquid Crystals & Plastic Crystals* vol. I Editors Gray et al., Ellis Horwood Limited, 1974, (Chap I, 2 & 3, Preface).

*Molecular Crystals & Liquid Crystals* Editors Dienes et al., "Carbonaceous Mesophase Disc-Like Nematic Liquid Crystal" by H. Gasparoux, Jan. 1981.

*Program and Abstracts* (Kyoto Japan Jun.-Jul. 1981) Session 6 "Mesophases of Disc-Like Molecular and Carbonaceous Materials".

H. Gasparous, C. Destrade, and Nguyen Huu Tinh, Nematic Disc-Like Liquid Crystal: A Model for the Carbonaceas *Mesophase,* 15th Conference on Carbon, pp. 176, 177 (1981).

*Primary Examiner*—Delbert E. Gantz
*Assistant Examiner*—Helane E. Maull
*Attorney, Agent, or Firm*—D. Fink

[57] ABSTRACT

A cholesteric mesophase pitch is disclosed along with methods for producing the same.

2 Claims, No Drawings

CHOLESTERIC MESOPHASE PITCH

The invention relates to mesophase pitch and particularly cholesteric mesophase pitch.

It is well known that the term "mesophase" is used interchangeably with the expression "liquid crystal" and that the class of materials identified by the term "mesophase pitch" is a nematic liquid crystal class.

There are three classes of liquid crystals: nematic, smectic, and cholesteric. All prior art mesophase pitches have been in the nematic liquid crystal class and analysis of mesophase pitch in the prior art indicates that mesophase pitches are limited to the nematic liquid crystal class.

The term "liquid crystal" is well known in the art and refers to a phase that lies between the rigidly ordered solid phase for which the mobility of individual molecules is restricted and the isotropic phase for which both molecular mobility and a lack of molecular order exists. The classes of liquid crystals are well known and can be described briefly in terms of rod-shaped molecules. Generally, the nematic liquid crystal structure can be visualized as an array of rod-like molecules which are substantially parallel to each other but have a disorganized arrangement of centers of gravity. In contrast, smectic liquid crystals have a stratified structure with the long axes of the rod-like molecules in parallel layers and the center of gravity in an ordered array. There are a number of sub-classes within the smectic liquid crystal class. The remaining class was first discovered and associated with cholesteryl esters and derived its name from the cholesterol family. Nevertheless, cholesteric liquid crystals are not restricted to the cholesterol family. The cholesteric liquid crystal structures have a natural screw structure. The structure can be visualized by considering a set of parallel planes and each plane has an arrangement of the molecules in a configuration like a nematic liquid crystal but the orientation of the molecules from one plane to the successive plane in a direction perpendicular to the planes exhibits a progressive angular rotation or twist. The rate of the angular rotation or twist angle from layer to layer is a characteristic parameter for a cholesteric liquid crystal structure.

The instant invention is a cholesteric mesophase pitch and a carbon fiber made from the cholesteric mesophase pitch.

In addition to the cholesteric mesophase pitch being a novel composition, this mesophase pitch has unusual properties with respect to the prior art mesophase pitches and is believed to be capable of producing a carbon fiber having relatively high compressive strength values with respect to the prior art mesophase pitch derived carbon fibers.

It has been well established in the prior art that a mesophase pitch suitable for spinning fibers should be capable of achieving a large domained structure, domains of about 200 microns or greater. Generally, the mesophase pitches in the prior art which were capable of producing only relatively small domains have also exhibited relatively high viscosities and were difficult to spin because the relatively high temperatures needed for spinning these mesophase pitches resulted in additional polymerization reactions. Additionally, it has been found that a mesophase pitch capable of achieving a large domained structure was suitable for producing carbon fibers which possessed relatively high values for Young's modulus.

It is known that carbon fibers produced from polyacrylonitrile do not go through a mesophase state and do not develop a long-range three dimensional graphitic structure as in the case of the mesophase pitch derived carbon fibers, but exhibit relatively high values of compressive strength. Furthermore, fibers marketed under the trade name of KEVLAR fibers which are spun from a nematic liquid crystal material also possess relatively low values for compressive strength.

It is known that cholesteric liquid crystals exhibit relatively small domain anisotropic structure due to the presence of many twist disclinations resulting from the changing orientation of the molecules in the cholesteric liquid crystal structure.

It is believed that carbon fibers produced from cholesteric mesophase pitch will possess improved values for compressive strength with respect to the prior art mesophase pitch derived carbon fibers, and still give high values of Young's modulus.

The amount of mesophase in a pitch can be evaluated by known methods using polarized light microscopy. The presence of homogeneous bulk mesophase regions can be visually observed by polarized light microscopy, and quantitatively determined by published methods.

The polarized light microscopy can also be used to measure the average domain size of a mesophase pitch. For this purpose, the average distance between extinction lines is measured and defined as the average domain size. To some degree, domain size increases with temperature up to about coking temperature. As used herein, domain size is measured for samples quiescently heated without agitation to about 400° C.

Softening point or softening temperature of a pitch, is related to the molecular weight constitution of the pitch and the presence of a large amount of high molecular weight components generally tends to raise the softening temperature. It is a common practice in the art to characterize in part a mesophase pitch by its softening point. The softening point is generally used to determine suitable spinning temperatures. A spinning temperature is about 40° C. or more higher than the softening temperature.

Generally, there are several methods of determining the softening temperature and the temperatures measured by these different methods vary somewhat from each other.

Generally, the Mettler softening point procedure is widely accepted as the standard for evaluating a pitch. This procedure can be adapted for use on mesophase pitches.

The softening temperature of a mesophase pitch can also be determined by hot stage microscopy. In this method, the mesophase pitch is heated on a microscope hot stage under an inert atmosphere under polarized light. The temperature of the mesophase pitch is raised at a controlled rate and the temperature at which the mesophase pitch commences to deform is noted as softening temperature.

The cholesteric pitch is produced by combining a mesophase pitch with a compatible optically active compound. If the optically active compound undergoes thermal reaction, then the resulting product should also be an optically active compound.

If the cholesteric mesophase pitch will be used to produce carbon fibers, then the optically active compound should be thermally stable at temperatures in the range of the spinning temperature to be used. That is, the optically active compound must retain its optically active properties at these temperatures.

Optically active compounds are well known in the art. Generally, the more similar the molecules are for the mesophase pitch and the optically active compound, the more likely that the two components will be compatible. The compatibility can be determined experimentally on the basis of the quality of the resulting cholesteric mesophase pitch.

In the examples herein, it was found that the precursor mesophase pitch suitable for producing the cholesteric mesophase pitch was a novel mesophase pitch having ellipsoidal molecules.

The mesophase pitch having ellipsoidal molecules is the subject of a concurrently filed patent application.

As used herein, the term "couple" or "coupling" in connection with polymerization shall mean the formation of a single bond between two reacting molecules and a molecular chain having such bonds can include more than two starting molecules.

As used herein, the term "condensation" is used in connection with polymerization between aromatic molecules is characterized by the establishment of at least two new bonds between the co-reacting molecules. This reaction, of course, is contrasted to coupling polymerization in which only single bonds are formed between co-reacting molecules.

As used herein, "ellipsoidal" refers to the general shape of a molecule having an approximately elliptical cross section in the plane of the molecule with an aspect ratio greater than 1:1, possibly greater than 2:1.

The mesophase pitch having ellipsoidal molecules is produced by the polymerization of an aromatic hydrocarbon containing at least two condensed rings for which 60% of the polymerization reactions are coupling polymerizations.

The process for producing a mesophase pitch having ellipsoidal molecules is carried out by the use of a weak Lewis acid for achieving polymerization which favors coupling polymerization. The weak Lewis acid is anhydrous $AlCl_3$ along with a moderating component. The second component must be a weaker acid such as anhydrous $CuCl_2$, $ZnCl_2$, $SnCl_2$, or the like in order to reduce the activity of the $AlCl_3$, and a solvent must be used such as o-dichlorobenzene, nitrobenzene, trichlorobenzene and the like.

Preferably, anhydrous $AlCl_3$ and anhydrous $CuCl_2$ along with o-dichlorobenzene is used in a mole ratio of the components $AlCl_3$, $CuCl_2$, and a precursor material in the range of about 1:1:2 to about 1:1:1. Preferably, the reaction is carried out a temperature from about 100° C. to about 180° C. for a time of from about 2 hours to about 20 hours.

The solvent used is preferably aromatic, must be non-reactive with the weak Lewis acid, must be polar, have a boiling point higher than about 100° C. and be a solvent for the precursor material.

After the reaction has been terminated, undesirable inorganic compounds can be removed by hydrolyzing and dissolving them with hydrochloric acid and the like, followed by filtering.

The polymerization reaction need not be carried out to produce the precursor mesophase pitch directly. Instead, the reaction may be terminated prior to the formation of the mesophase pitch or at a point when a predetermined level of mesophase content for the mesophase pitch has been reached. Thereafter, subsequent steps as taught in the prior art can be used to convert an isotropic pitch to a mesophase pitch or increase the mesophase content of the mesophase pitch to a predetermined amount.

The illustrative, non-limiting examples of the practice of the invention are set out below. Numerous other examples can readily be evolved in the light of the guiding principles and teachings contained herein. Examples given herein are intended to illustrate the invention and not in any sense to limit the manner in which the invention can be practiced. The parts and percentages recited herein, unless specifically stated otherwise, refer to parts by weight and percentages by weight.

Preferably, the optically active compound is a cholesteric liquid crystal such as cholesteryl, acetate, cholesteryl benzoate, and cholesteryl nonanoate. Cholesterol can be used even though it is not a liquid crystal.

Generally, a range of about 1% to 2% by weight of the cholesteric liquid crystal can be used. In order to establish a homogenous mixture, it is preferable to stir the mixture above the melting point of the mesophase pitch. The cholesteric structure can be observed either by hot-stage polarized microscopy or room temperature microscopy of quenched samples in encapsulated epoxy mounts in accordance with known methods. The cholesteric mesophase pitch can be spun into fibers at a temperature at which the material has suitable viscosity.

EXAMPLE 1

45 grams of naphthalene and 45 grams of phenanthrene were reacted with 45 grams of anhydrous $AlCl_3$ and 45 grams of anhydrous $CuCl_2$ and 250 milliliters of o-dichlorobenzene for 26 hours at a temperature of about 180° C. The solvent was removed by distillation under nitrogen and the solid residue was hydrolyzed with water and concentrated hydrochloric acid. The solid residue was then heated under nitrogen to a temperature of about 380° C. for 1 hour in order to remove residual solvents. The product obtained amounted to a 64% by weight yield and contained about 10% by weight mesophase in the form of small spheres. This solid residue was then heat treated at a temperature of about 390° C. for 4 hours while being sparged with nitrogen in accordance with conventional methods. The product obtained amounted to a 74% by weight yield and had a Mettler softening point of about 236° C. The product contained about 100% by weight mesophase in the form of large coalesced domains.

A mixture was made of 0.98 grams of the mesophase pitch and 0.02 grams of cholesteryl acetate and then annealed at about 350° C. for 30 minutes. Cholesteryl acetate exhibits a cholesteric liquid phase at a temperature of 99° C. when cooled from the melt and solidifies to a crystalline solid below that temperature.

The annealed mixture was cooled to room temperature and examined by polarized light microscopy. The mixture contained about 100% by weight mesophase and the mesophase exhibited a typical twist extinction pattern of a cholesteric liquid crystal. The extinction lines were uniformly distributed throughout the mesophase structure with an average separation of from about 10 microns to about 15 microns. The cholesteric liquid crystal structure was also observed when the mixture was examined under polarized light microscopy at a temperature of about 300° C.

For comparison, the same percentage of cholesteryl acetate was added to a conventionally prepared mesophase pitch produced from a petroleum pitch and having 100% by weight mesophase. After heating at a temperature of about 350° C. for ½ hour. the mixture maintained an appearance of a prior art nematic mesophase pitch. There was no appearance of a cholesteric liquid crystal structure and moreover, the cholesteryl acetate did not appear to be compatible with this mesophase pitch.

A second mixture was prepared by combining the naphthalene-phenanthrene mesophase pitch with 20% by weight of the cholesteryl acetate and melting the mixture at a temperature of about 380° C. for ½ hour. The mixture contained a pronounced cholesteric liquid crystal structure with uniform twist extinction lines from about 8 microns to 10 microns apart. The overall mesophase content was reduced to about 80% by weight and indicated that only a small portion of the cholesteryl acetate was needed to bring about the cholesteric liquid crystal structure while the remainder of the cholesteryl acetate increased the isotropic phase content.

For comparison, the conventional mesophase pitch was combined with 20%, by weight of the cholesteryl acetate and melted at a temperature of about 380° C. for ½ hour. No change in the appearance of the mixture from the prior art mesophase pitch was observed and the isotropic phase content was about 80% by weight.

EXAMPLE 2

A second naphhalene-phenanthrene mesophase pitch was prepared as in Example 1 except the heat treatment with the $AlCl_3$ and $CuCl_2$ was only 20 hours. The product obtained after the heat treatment at 390° C. contained about 80% by weight mesophase in the form of large coalesced domains and the mesophase pitch had a softening point of about 230° C.

Four runs were made by combining the mesophase pitch with 1%. 2%, 5% and 10% by weight of cholesteryl acetate. For each run, the mixture was annealed at a temperature of about 350° C. for ½ hour under nitrogen. Each of the annealed samples exhibited a cholesteric liquid crystal structure with twist extinction lines about 10 microns apart. It is interesting that the isotropic phase content of the cholesteric mesophase pitch increased with the increase in the amount of cholesteryl acetate used. The isotropic content for each run was 15%, 20%, 30% and 40% by weight for the cholesteryl acetate contents of 1%, 2%, 5%, and 10% by weight, respectively. The cholesteryl acetate not only brings about the cholesteric liquid crystal structure but also tends to increase the isotropic phase content for excessive amounts of the cholesteryl acetate.

EXAMPLE 3

The naphthalene-phenanthrene mesophase pitch prepared in Example 1 was mixed with 2% by weight cholesteryl benzoate and melted at a temperature of about 300° C. for ½ hour. The cholesteryl benzoate exhibits a cholesteric liquid crystal structure in a temperature range of about 148° C. to about 176° C. Above 176° C. it is an isotropic liquid. The annealed mixture was examined at room temperature by polarized light microscopy and was found to exhibit a typically cholesteric liquid crystal structure. In addition, the annealed mixture contained about 100 by weight mesophase.

For comparison, the same percentage of cholesteryl benzoate was added to the conventionally prepared mesophase pitch of Example 1. It was found that no apparent change in the appearance of the mesophase pitch occurred so that it can be concluded that no interaction took place.

EXAMPLE 4

The naphthalene-phenanthrene mesophase pitch of Example 1 was blended with 2% by weight of cholesterol. Cholesterol is known to be an optically active compound, but does not exhibit a liquid crystal transition. After annealing at a temperature of about 350° C. for ½ hour, the blend was found to exhibit a cholesteric liquid crystal structure and contained about 100% by weight mesophase.

EXAMPLE 5

The naphthalene-phenanthrene mesophase pitch of Example 2 was blended with 0.5% by weight cholesteryl acetate to determine if this small amount of optically active compound could transform the mesophase pitch from a nematic liquid crystal structure to a cholesteric liquid crystal structure. After annealing at about 350° C. for ½ hour, it was found that the mixture contained about 80% by weight mesophase and exhibited numerous extinction lines. The separation between the twist extinction lines was on the average about 60 microns. The observed extinction lines did not give evidence of a cholesteric liquid crystal structure as pronounced as observed in Example 2 for the runs using 1% and 2% by weight cholesteryl acetate.

EXAMPLE 6

The naphthalene-phenanthrene mesophase pitch of Example 2 was blended with 2% by weight of cholesteryl nonanoate. This compound melts to a smectic phase at about 78° C., transforms to a cholesteric phase at about 79° C., and then changes to an isotropic liquid at about 90° C. After annealing the blend at about 350° C. for ½ hour, the blend was found to contain about 80% by weight cholesteric mesophase.

EXAMPLE 7

The precursor mesophase pitch for preparing the cholesteric mesophase pitch can be produced by reacting an aromatic hydrocarbon containing at least one condensed ring with anhydrous $AlCl_3$ and an acid salt of an organic amine which acid salt reduces the activity of the $AlCl_3$, and is miscible with the $AlCl_3$ to form a molten eutectic salt mixture reactive with the aromatic hydrocarbon. This process is the subject of another concurrently filed Patent Application. Some care must be taken in carrying out this process to produce a precursor mesophase pitch having properties favorable for producing the cholesteric mesophase pitch.

Accordingly, a precursor mesophase pitch was prepared by reacting 100 grams of naphthalene with 50 grams of anhydrous $AlCl_3$ and 25 grams of pyridine hydrochloride for 25 hours at a temperature of about 150° C. to produce a product which was hydrolyzed with water and hydrochloric acid and filtered to obtain a residue which was thereafter subjected to a heat treatment for 18 hours at a temperature of about 400° C. The precursor mesophase pitch had a mesophase content of about 100% by weight. The precursor mesophase pitch was blended with 5% by weight cholesteryl benzoate and the mixture was melted at a temperature of about 300° C. in an inert atmosphere.

After cooling to room temperature, an examination under polarized light microscopy revealed a complete cholesteric liquid crystal structure.

The same results were obtained when the precursor mesophase pitch was blended with 5% by weight cholesteryl acetate.

EXAMPLE 8

A naphthalene-phenanthrene mesophase pitch similar to the one prepared in Example 1 was made and had a mesophase content of about 90% by weight and a softening point of about 225° C. The mesophase pitch was blended with 2% by weight cholesteryl acetate and stirred in a spinning pot at a temperature of about 300° C. to homogenize the mixture. The blend was spun at a temperature of about 250° C. into monofilaments having diameters of about 13 microns. The temperature needed for spinning the blend was lower than the temperature which would have been needed for the naphthalene-phenanthrene mesophase pitch, namely a temperature of 272° C. The fibers were carefully thermoset because of the low softening point and thereafter carbonized to a temperature of 2500° C. in accordance with the prior art. The fibers had an average Young's modulus of 193 GPa at an average tensile strength of about 1.72 GPa.

EXAMPLE 9

A naphthalene-phenanthrene mesophase pitch was prepared according to Example 1 and contained about 100% by weight mesophase and had a softening point of about 243° C. The mesophase pitch was blended with 1% weight cholesteryl acetate at a temperature of 300° C. under a nitrogen atmosphere. The blend was found to be 100% cholesteric mesophase pitch. The cholesteric mesophase pitch was spun at a temperature from about 248° C. to 270° C. into monofilaments having diameters of about 10 microns. The fibers were thermoset. Photomicrographs of the thermoset fibers showed large domained anisotropic structure in sections parallel to the axis and unusually very small domained anisotropic structure in transverse sections. This structure exhibited a single off-center extinction not previously seen in mesophase pitch fibers.

The fibers were carbonized to 2500° C. in accordance with conventional methods and resulted in fibers having an average Young's modulus of about 262 GPa and an average tensile strength of about 2.41 GPa.

I wish it to be understood that I do not desire to be limited to the exact details described herein for obvious modifications will occur to a person skilled in the art.

Having thus described the invention, what I claim as new and desire to be secured by Letters Patent is as follows:

1. A cholesteric pitch produced by combining a mesophase pitch having ellipsoidal molecules with a compatible optically active compound, said mesophase pitch being produced by reacting a weak Lewis acid with an aromatic hydrocarbon containing at least two condensed rings in the presence of a polar solvent of the aromatic hydrocarbon which solvent is non-reactive with said Lewis acid.

2. The cholesteric pitch of claim 1, wherein the content of said optically active compound is from about 1% to about 2% by weight.

* * * * *